United States Patent [19]

Estkowski et al.

[11] Patent Number: 4,718,726

[45] Date of Patent: Jan. 12, 1988

[54] CHAIR SEAT TILT CONTROL

[76] Inventors: Michael H. Estkowski, 1756 Outer Dr., St. Joseph, Mich. 49085; Jerome C. Caruso, 1165 W. Ash Lawn Dr., Lake Forest, Ill. 60045; Don E. Minor, 332 S. Church St., Coloma, Mich. 49038

[21] Appl. No.: 70,415

[22] Filed: Jul. 7, 1987

[51] Int. Cl.[4] ..... A47C 3/00

[52] U.S. Cl. ..... 297/313; 297/300; 297/303; 297/304

[58] Field of Search ..... 297/313, 311, 300, 301, 297/302, 303, 304, 333

[56] References Cited

U.S. PATENT DOCUMENTS

| | | | |
|---|---|---|---|
| 555,029 | 2/1896 | Watkins et al. | 248/575 |
| 2,249,828 | 7/1941 | Herold | 297/376 |
| 2,991,125 | 7/1961 | Lie | 297/304 |
| 3,131,904 | 5/1964 | Lie | 248/373 |
| 3,240,528 | 3/1966 | Ciuffini et al. | 297/303 |
| 3,480,249 | 11/1969 | Lie | 248/373 |
| 3,592,433 | 7/1971 | Fuhrman | 248/373 |
| 3,659,819 | 5/1972 | Wolters | 248/373 |
| 3,669,398 | 6/1972 | Robinson | 248/373 |
| 3,813,073 | 5/1974 | Mohr et al. | 248/373 |
| 3,868,144 | 2/1975 | Lie | 297/304 |
| 4,185,803 | 1/1980 | Kalvatn | 248/608 |
| 4,295,626 | 10/1981 | Large | 248/575 |
| 4,390,206 | 6/1983 | Faiks et al. | 297/300 |
| 4,431,157 | 2/1984 | Arild | 248/583 |
| 4,438,898 | 3/1984 | Koblauch | 297/304 X |
| 4,575,151 | 3/1986 | Edstrom | 297/304 |
| 4,640,548 | 2/1987 | Desanta | 297/301 |
| 4,695,093 | 9/1987 | Suhr | 297/300 |

*Primary Examiner*—James T. McCall

[57] ABSTRACT

A seat support mechanism for a tilting chair with separate adjustments for front and rear tilt, which mechanism includes interconnected torsion bars which are adjustable to vary the resilient restraining force which opposes rearward tilt of the seat when occupied. The support mechanism also includes a separate torsion member and adjustment to vary the resilient restraining force opposing front tilt of the seat when the seat occupant leans forward.

7 Claims, 4 Drawing Figures

CHAIR SEAT TILT CONTROL

BACKGROUND OF THE INVENTION

This invention relates to a seat support mechanism for a tiltable chair of the type commonly found in offices. It is known in the art to tiltably support a seat of a chair utilizing a torsion bar spring mechanism. A torsion bar extends transversely of the seat having one of its ends nonrotatably secured relative to the member to be tilted and the other end nonrotatably secured to a support member whereby tilting of said member about the longitudinal axis of the torsion bar is restrained by twisting of said bar. See, for example, U.S. Pat. Nos. 2,991,125, 3,131,904, 3,480,249, 3,592,433, and 4,295,626.

It is also known that instead of utilizing a single torsion bar, a pair of torsion bars can be used to decrease the overall width and provide a more compact construction, one end of one torsion bar being nonrotatably connected to a member supporting the frame, both torsion bars being interconnected to twist under reciprocal influence to act as a single torsion bar. See, for example, U.S. Pat. No. 3,868,144.

All of these prior art patents, however, have focused on an arrangement which resists only the rearward tilt of the seat of a chair when the occupant leans backward. None have provided a mechanism with separate axes and separate controls for front and rear tilt.

SUMMARY OF THE INVENTION

The present invention is directed to a support mechanism for a chair with a tiltable seat with separate adjustments for front and rear tilt. It provides one axis disposed toward the front portion of the seat about which the seat pivots to accommodate rear tilt. This minimizes rise of the seat front when rear tilt is utilized. The resistance to rear tilt is provided by a dual torsion bar arrangement that is adjustable to vary the resistance to rear tilt so that the chair can accommodate occupants of substantially different weight. The support mechanism also provides a second axis about which the seat can pivot to accommodate front tilt. This includes a torsion member which resists tilt in the forward direction when an occupant leans forward of center of the torsion member axis. The front tilt torque resistance is also adjustable.

DETAILED DESCRIPTION OF THE PREFERRED EMBODIMENT

Figure 1:
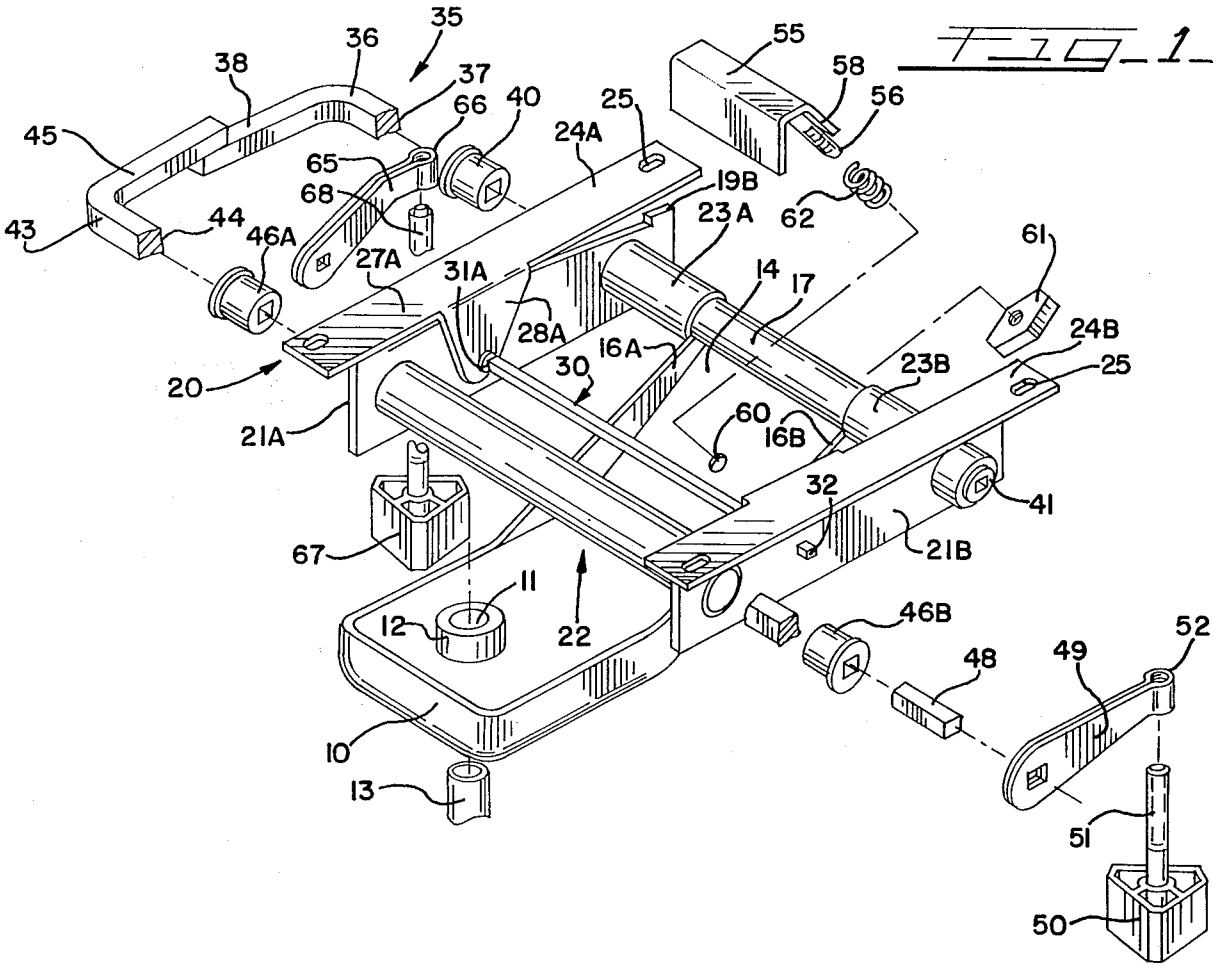
FIG. 1 is an exploded perspective view showing the elements of the support mechanism of the present invention.

FIG. 1 illustrates, in exploded view, the elements of the support mechanism for a tiltable chair. The support mechanism includes a base member 10 including an aperture 11 formed toward one end thereof with an annular collar or sleeve 12 concentric with the aperture 11 and extending upwardly from the base member 10. The purpose of the aperture 11 and collar 12 are to receive a chair post 13 which furnishes primary support for the chair and seat. The post 13 is generally supported at its lower end by some form of pedestal arrangement often consisting of four or more legs radially extending from the chair post. The rigid connection between the chair post 13 and the base member 10 through aperture 11 and sleeve 12 provides a relatively rigid support for the base member and its connected components.

Figure 4:
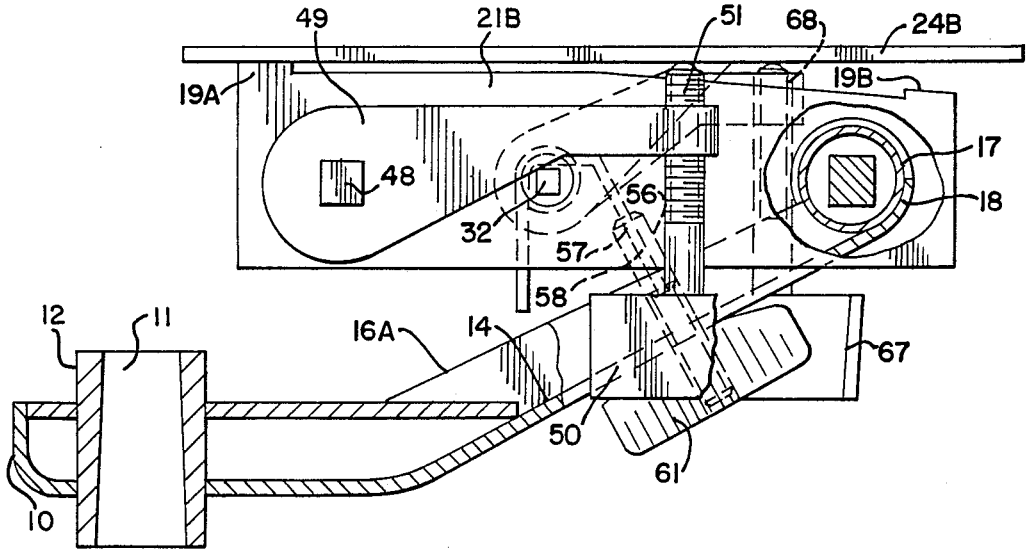
FIG. 4 is a side section taken generally along the center of the support mechanism shown in FIG. 2.

The base member 10 extends angularly upwardly through panel 14 and upwardly extending braces 16A and 16B. As best shown in FIG. 4, the base member 10 is rigidly connected to a first tube 17 in any of a number of conventional methods including, for example, welding. The panel 14 terminates in an upwardly extending flange section 18 which is disposed forwardly of the tube 17 and is secured thereto.

A seat support assembly 20 is provided consisting of a number of interconnected elements. A pair of side plates 21A and 21B are disposed parallel and spaced apart from each other, and a hollow second tube 22 is connected between the side plates toward the rear thereof. As best shown in FIG. 4, the side plates each include a pair of upwardly extending stops 19A and 19B. The support assembly further includes a pair of concentrically disposed hollow sleeve members 23A and 23B, connected to the respective side plates 21A and 21B and extending inwardly from said plates toward each other. The tube 17 extends through both sleeves 23A and 23B in a manner such that the sleeves, side plates, and tube 22 are all rotatable as a unit about the tube 17 which is fixed to the base member 10. Thus, the central axis of the tube 17 is the axis about which the seat support assembly pivots to accommodate rear tilt.

Figure 2:
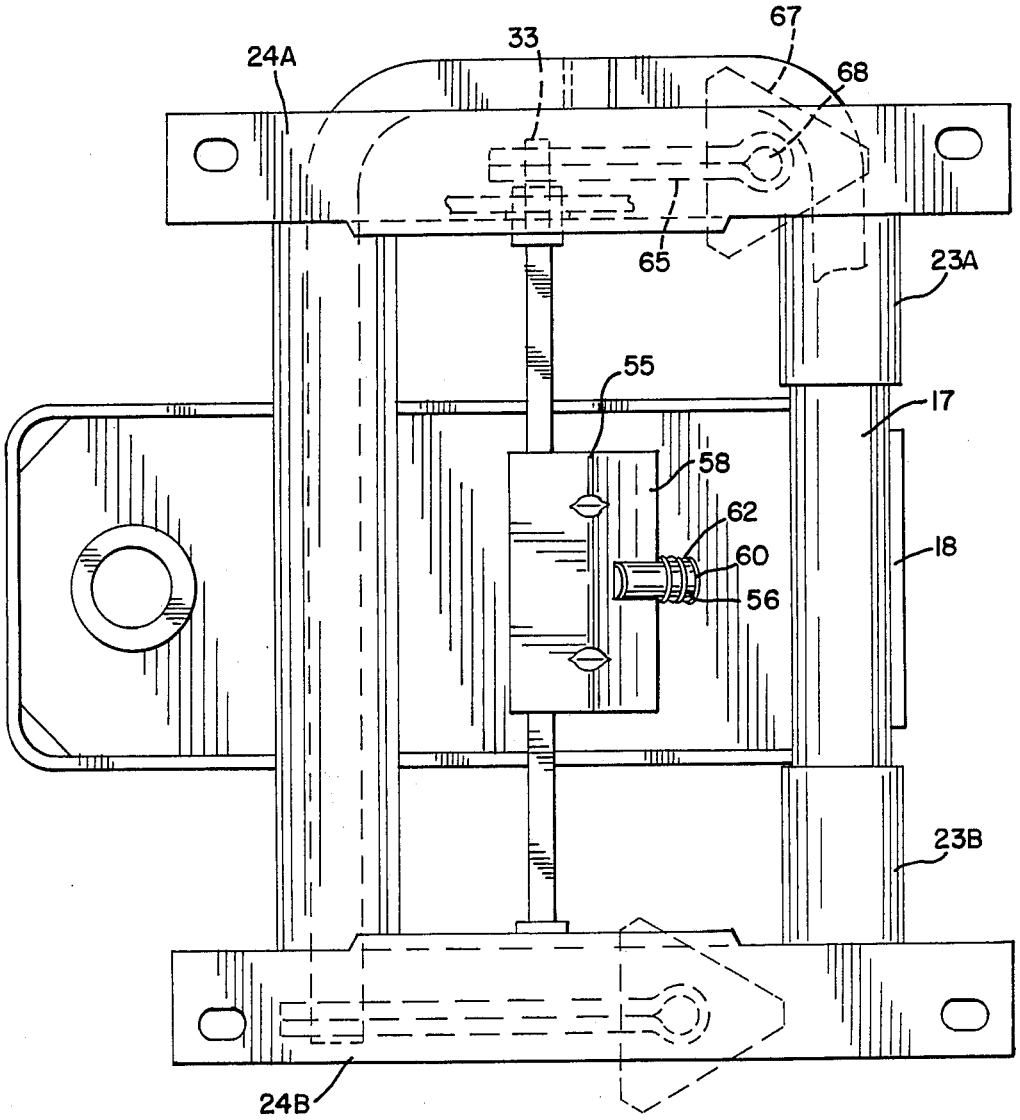
FIG. 2 is a top elevation of the support mechanism.
Figure 3:
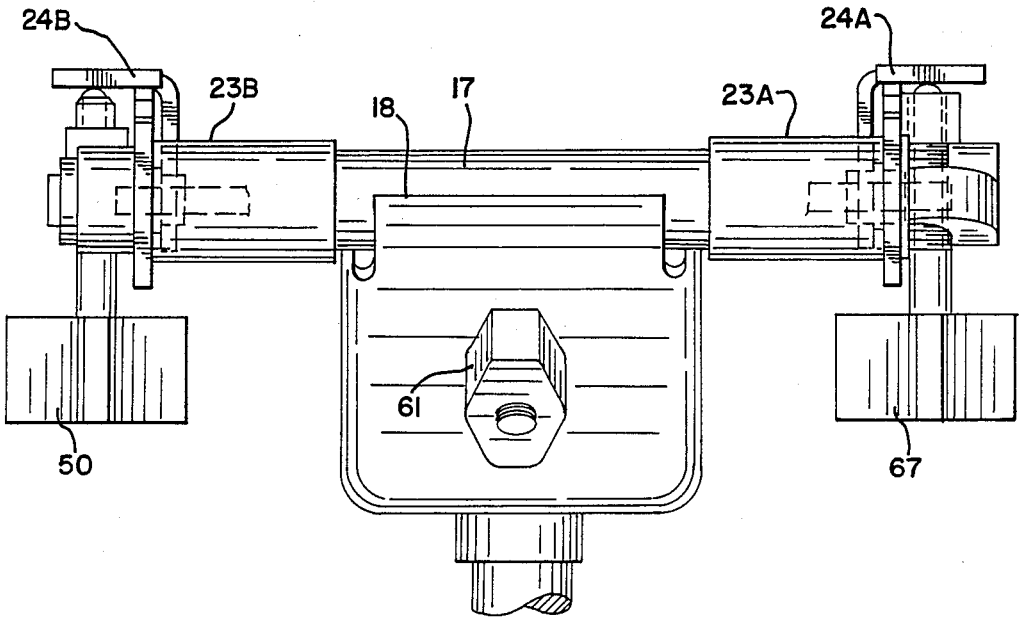
FIG. 3 is a frontal elevation of the support mechanism shown in FIG. 2.

The seat support assembly 20 further includes a pair of brackets 24A and 24B, which are adapted to be connected to a seat of the chair through apertures 25 provided therein. The brackets 24 include a flat face portion 27 and a flange 28 extending substantially perpendicular to the flat face portion 27. A torsion member 30 extends through apertures 31 provided in both flanges 28 to pivotally support the brackets 24 thereon. The torsion member 30 is nonrotatably connected to side plate 21B and extends therethrough, as shown at end 32. The other end 33 of torsion member 30, as shown in FIG. 2, extends through side plate 21A and is supported for relative rotation therein. The central axis of the torsion member 30 is the axis about which the seat pivots to accommodate front tilt.

The seat support assembly consists of the side plates 21, tube 22, sleeves 23, brackets 24, and torsion member 30. The rear tilt features become operative when the seat is occupied such that the support assembly pivots in a counterclockwise direction, as viewed in FIG. 4, about the central axis of the tube 17. For all practical purposes, the base 10 remains rigid on its supporting chair post 13. The front tilt features, which will be described in greater detail, become operative when the chair occupant leans forward urging the brackets 24 to pivot clockwise, as viewed in FIG. 4, about the central axis of the torsion member 30.

A rear tilt torque resistant mechanism 35 includes a first torsion bar 36 having a leg 37 which extends through the tube 17. The torsion bar 36 includes another leg 38, which is bent perpendicular to the leg 37 and extends outwardly of the tube 17. A bushing 40 rotatably supports the torsion bar 36 within the sleeve 23A. A second bushing 41 supports the other end of the leg 37 in the sleeve 23B, but bushing 41 nonrotatably connects the leg 37 to the tube 17 precluding relative rotation therebetween. This can be accomplished in any of a number of manners including rigidly connecting the bushing 41 to the tube 17. In this manner, the leg 38 is free to pivot about the central axis of the tube 17 only to the extent that the leg 37 can twist about its fixed end. The torsion bar 36, however, is constructed of a material with desirable torsion characteristics and dimensioned such that twisting or torsion within certain parameters is permitted.

A second torsion bar 43 is provided, of dimension, material, and design, substantially similar to the first torsion bar 36. The torsion bar 43 includes a leg 44 which extends through the tube 22 and a second leg 45 perpendicular to the leg 44 which is adapted to engage and coact with the leg 38 of the torsion bar 36. The torsion bar 43 is rotatably supported within the tube 22 by a pair of bushings 46A and 46B which are rotatably mounted within the ends of the tube 22. An end 48 of torsion bar 43 extends outwardly from the bushing 46B. A lever 49 is connected to the end 48 and is rotatable with the torsion bar 43. An adjustment knob 50 is connected to a threaded element 51 which is threadably received within a collar 52 provided at the end of the lever 49. As best shown in FIG. 4, when the knob 50 is rotated, the threaded member 51 advances within the collar 52 until the tip of the member 51 engages the underside of the bracket 24B. At this point, rear pivot of the seat about the tube 17 is opposed by the leg 45 engaging the leg 38. The extent to which rotation takes place is a function of the load exerted on the seat and the torsion characteristics of the torsion bars.

Further rotation of the knob 50 beyond its initial engagement with the bracket causes the seat (not shown) and both connected brackets 24 to pivot counterclockwise about the central axis of the torsion member 32 until the rear portion of each bracket 24 contacts the stop 19A which extends upwardly from the side plates 21, as shown in FIG. 4. Further rotation of the knob 50 causes the lever 49 to rotate clockwise about the central axis of the torsion bar 43, as shown in FIG. 4. This action causes a preload to be imposed on the torsion bar mechanism by causing a rotation of the torsion bar 43 resulting in the end 45 exerting a downward force on the end 38 of the torsion bar 36. The net effect of this preloading action is to urge the entire seat support assembly to pivot in a clockwise direction about the central axis of the tube 17.

Provisions are made to limit clockwise rotation of the support assembly about the central axis of the tube 17 when the chair is in its at-rest or unloaded condition. A hook-shaped bracket 55 is shown in FIG. 2 engaging the torsion member 30. The bracket is supported by a threaded rod 56 which defines a groove 57 in its outer end. The groove 57 is adapted to receive a flange 58 of the bracket 55 therein, as best shown in FIG. 4. The threaded member 56 extends through an aperture 60 formed in the base member 10. The threaded member 56 is connected at its other end to an adjustment knob 61 so as to vary the position of the bracket 55. A spring 62 is shown interposed between the bracket 55 and the base member 10. The purpose of the bracket 55 is to provide an adjustable limit for rotation of the seat support assembly when the chair is unoccupied. The bracket 55, as shown in FIG. 4, is positioned over and engages the torsion member 30 at a location above the base member 10. The threaded arrangement between the rod 56 and the adjustment knob 61 provides adjustability for this at-rest seat tilt position. If the knob 61 is rotated in a manner to cause the bracket 55 to rise from the position shown in FIG. 4, this will allow the seat support assembly to pivot further in a clockwise orientation about the central axis of the tube 17. Corresponding rotation of the knob 61 in the opposite direction will lower the position of the at-rest seat position.

Adjustment of the front-tilt torque resistance is also provided for. As shown in FIG. 2, the end 33 of the torsion member 30 extends outwardly from the side plate 21A. Connected to the end 33 is a lever 65 which includes a threaded collar 66 disposed at one end. An adjustment knob 67 is connected to a threaded member 68 which is rotatable within the collar 66. Rotation of the knob 67 cause the end of the threaded member 68 to engage the lower end of bracket 24A causing both brackets to rotate in a counterclockwise direction, as shown in FIG. 4, until the ends of the brackets 24 engage the stop members 19A at the rear of the side plates 21. Further rotation of the knob 67 causes the arm 65 to rotate in a clockwise direction, as viewed in FIG. 4, thereby causing a twisting of the torsion member 30 and preloading of same. This action increases the torque on the member 30 and provides a resistive force acting to retard clockwise rotation of the bracket 24A about the torsion member 30 when a chair occupant leans forward. This front tilt adjustment only becomes operative when the occupant of the chair leans forward in a manner to shift the center of gravity of the load applied on the seat to a point forward of the torsion member 30.

The operation of the present invention is as follows. Initially, the user of the chair adjusts the at-rest or unloaded position of the seat. This is done by adjustment of the position of bracket 55 through the adjustment knob 61. Once the seat is in the desired unloaded position, the chair occupant can adjust the torque of the rear tilt restraining force and the front tilt restraining force to desirable levels by trial and further adjustment. Obviously, the heavier is the occupant of the chair, the more torsion resistance should be built into the support mechanism. Rotation of the knob 50 in a clockwise direction, causing clockwise rotation of the lever 49, as viewed in FIG. 4, increases the preload and resistance to rear tilt. The chair occupant may need to test the tilt on several occasions increasing the preload each time until a comfortable resistance has been obtained. The rear tilt adjustment element 51 impinges against bracket 24B, which engagement occurs forward of torsion bar 30. This affects the forward tilt resisting torque. In this manner, the adjustment knob 50 varies the torque on both the back tilt and front tilt.

A similar procedure is then conducted in connection with the torque adjustment for the front tilt. As previously described, the front tilt resistance comes into play when the occupant leans forward in the chair such that the center of gravity of the load is located forward of the torsion bar 30. For occupants of greater weight, it may generally be desired to increase the torque resistance to forward tilt as provided by adjustment knob 50 alone. This is done by rotation of the knob 67 in a clockwise direction so as to cause a corresponding clockwise rotation of the lever 65, as viewed in FIG. 4. Through a number of sittings and corresponding adjustments, the occupant will find a setting of the front tilt torque adjustment mechanism that is suitable for his particular weight.

When the occupant sits rearward in the chair, the rear tilt or rotation of the seat support assembly in a counterclockwise direction about the tube 17 will be opposed by the rear tilt torque resistance mechanism 35. When the occupant leans forward, front tilt will be resisted by the rear tilt mechanism 35 plus the front tilt torque resistant mechanism including the torsion member 30. The front tilt and the rear tilt pivot about separate axes.

Various features of the invention have been particularly shown and described in connection with the illustrated embodiments of the invention, however, it must be understood that these particular arrangements merely illustrate and that the invention is to be given its fullest interpretation within the term of the appended claims.

What is claimed is:

1. A support mechanism for a tiltable chair with separate adjustments for front tilt and rear tilt including a base member adapted to be supported on a chair post, a first tube connected to said base member, said tube having a central axis, a seat support assembly including a pair of side plates, a second tube connected between and toward the rear of said side plates, a first sleeve member connected to one of said side plates toward the front end thereof, a second sleeve member concentric with said first sleeve member connected to said other of said side plates toward the front end thereof, said first and second sleeve members rotatably supported over ends of said first tube, and a pair of brackets, each bracket associated with one of said side plates and angularly tiltable with respect thereto, each bracket adapted to be connected to support a seat of said chair, a first torsion bar extending through and non-rotatably connected to one end of said first tube, said first torsion bar including an arm disposed external to said first tube, a second torsion bar extending through and rotatably supported within said second tube, said second torsion bar including an arm disposed external to said second tube and adapted to engage said arm of said first torsion bar, said first and second torsion bars operative to resist counterclockwise rotation of said seat support assembly about said first tube thereby resisting rear tilt of said seat, rear tilt torque adjustment means connected to one of said torsion bars to vary the torque exerted by said torsion bars to resist rearward tilt of said seat about said first tube, a torsion member pivotally supporting said brackets and non-rotatably connected at one end to one of said side plates and, at said other end, engageable with one of said brackets to exert a force resisting clockwise rotation of said seat about said torsion member thereby resisting front tilt of said seat and front tilt torque adjustment means connected between said torsion member and one of said brackets, said adjustment means operable to vary the torque to resist forward tilt of said seat about said torsion member.

2. A support mechanism as in claim 1 in which said first tube is positioned forward of center of said side plates to thereby minimize upward movement of the front of said seat during rear tilt.

3. A support mechanism as in claim 1 including a stop mechanism to limit clockwise rotation of said seat about said first tube.

4. A support mechanism as in claim 3 including adjustment means associated with said stop mechanism to vary the position of said seat when unloaded.

5. A support mechanism as in claim 4 in which the adjustment means associated with said stop mechanism includes a bracket adapted to engage said torsion member and an adjusting screw disposed between said base member and said bracket whereby rotation of said adjusting screw varies the position of said bracket thereby limiting the clockwise rotation of said seat about said second tube.

6. A support mechanism as in claim 1 in which said front tilt torque adjustment means does not become effective until the center of gravity of a load applied to said seat is positioned forwardly of the central axis of said torsion member.

7. A support mechanism as in claim 1 in which said first tube serves as a pivotal axis for rear tilt of said seat support assembly and said torsion bar serves as a separate and independent pivotal axis for front tilt of said seat.

* * * * *